US005084823A

United States Patent [19]

Andrews, III et al.

[11] Patent Number: 5,084,823

[45] Date of Patent: Jan. 28, 1992

[54] METHOD FOR DETERMINING LEVEL OF BULK AND CONTROL THEREOF

[75] Inventors: Richard S. Andrews, III, Greenwood; Nitin J. Champaneria, Seaford, both of Del.

[73] Assignee: E. I. Du Pont de Nemours and Company, Wilmington, Del.

[21] Appl. No.: 433,820

[22] Filed: Nov. 9, 1989

[51] Int. Cl.[5] ..... G06F 15/46; D02G 1/16

[52] U.S. Cl. ..... 364/470; 28/220; 57/264; 364/164

[58] Field of Search ..... 364/470, 148, 164, 115, 364/149-151; 28/220, 241, 250, 248, 257, 271; 73/160; 57/205, 245, 246, 350, 264; 8/400

[56] References Cited

U.S. PATENT DOCUMENTS 4,819,310 4/1989 Beerli et al. ..... 364/470 X 4,899,286 2/1990 Colli et al. ..... 364/470

*Primary Examiner*—Joseph Ruggiero

[57] ABSTRACT

An apparatus that includes speed, temperature, tension, position and pressure sensors on a BCF yarn spinning machine in connection with a digital computer incorporates models in the computer which predict yarn bulk and dyeability properties as a function of sensor inputs: hot roll temperature, bulking jet temperature, ladder guide tension, relative viscosity, draw zone tension, Hall-effect Watt-meter measuring the power consumption of the spinning pump, finish roll speed, takeup roll speed, wind up speed and wind up tension.

6 Claims, 10 Drawing Sheets

METHOD FOR DETERMINING LEVEL OF BULK AND CONTROL THEREOF

BACKGROUND OF THE INVENTION

This invention relates to the manufacture of synthetic fibers and more particularly it relates to a method for determining yarn property characteristics from an interactive set of process conditions sensed during the manufacture of the fibers.

Both yarn manufacturers and fabric producers are faced with the variations in yarn properties (e.g. dyeability and bulk) and the effect of these variations on fabrics. In the past, the effects of these variations in actual fabric could only be determined by actually making test fabrics from the yarns which is expensive and time consuming. Now there are methods for simulating fabric appearance by just knowing the constituent yarn properties without having to make the fabrics and there are methods for determining yarn properties by measuring velocity of the filaments as they are spun as disclosed in U.S. Pat. No. 4,719,060.

SUMMARY OF THE INVENTION

The present invention provides a method of determining yarn property characteristics such as bulk as disclosed by Breen and Lauterbach in U.S. Pat. No. 3,186,155 and Anthraquinone Milling Blue BL dye uptake rate (MBB) by sensing process conditions, generating signals representative of those conditions and feeding the signals to a computer programmed with a property prediction algorithm. The real time system to predict yarn properties disclosed herein provides an opportunity to take remedial action and to limit the quantity of yarn processed outside the desired product property specification. These algorithms predict in real time the properties of bulk and yarn structure dyeability as measured by MBB dye uptake rate. There is excellent correlation with bulk and dyeability measured by means of off-line laboratory testing.

DETAILED DESCRIPTION OF THE ILLUSTRATED EMBODIMENTS

Figure 1A:
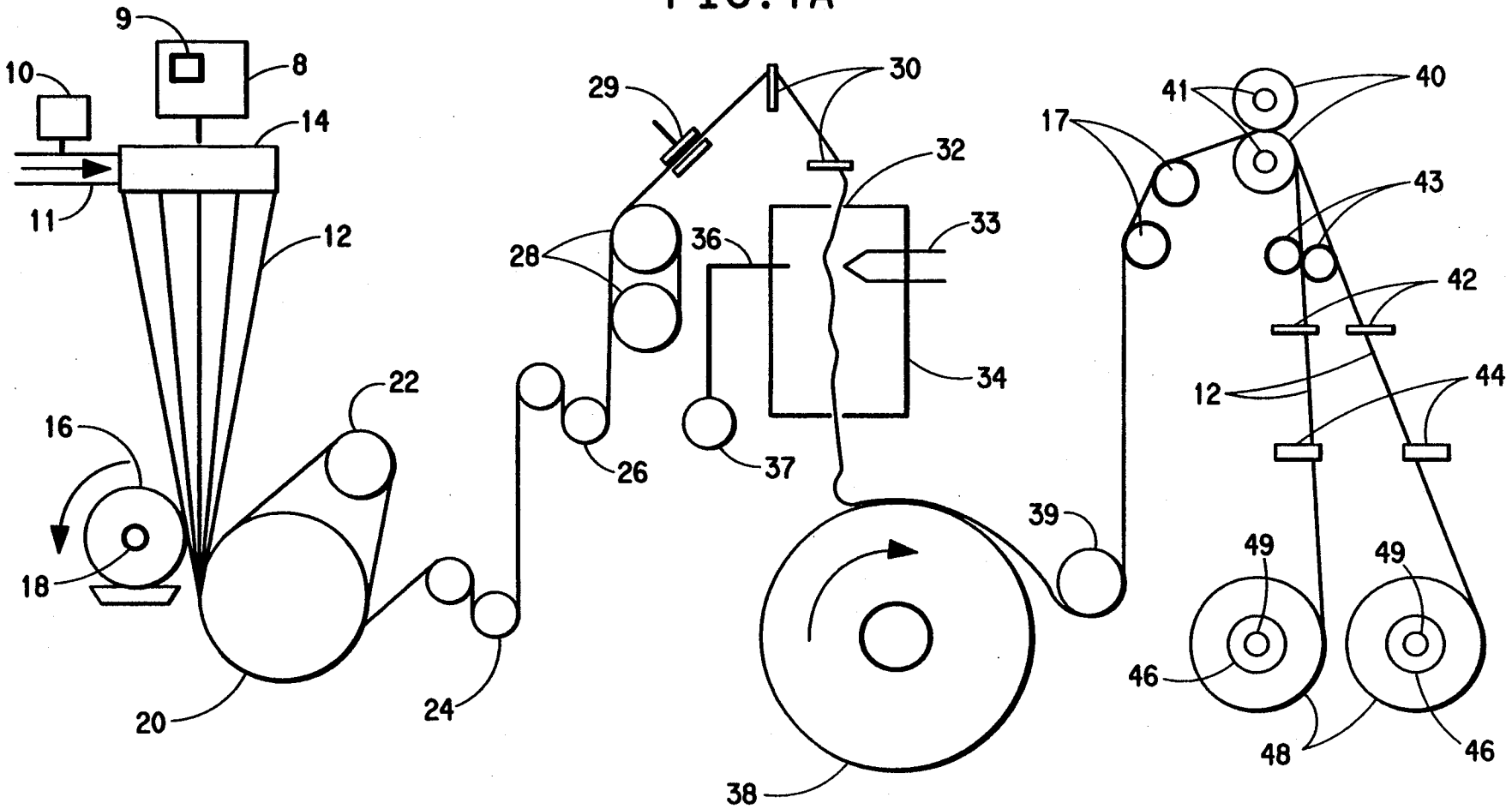
FIG. 1*a* is a schematic illustration of a bulked continuous filament yarn manufacturing process in which this invention is useful.
Figure 1B:
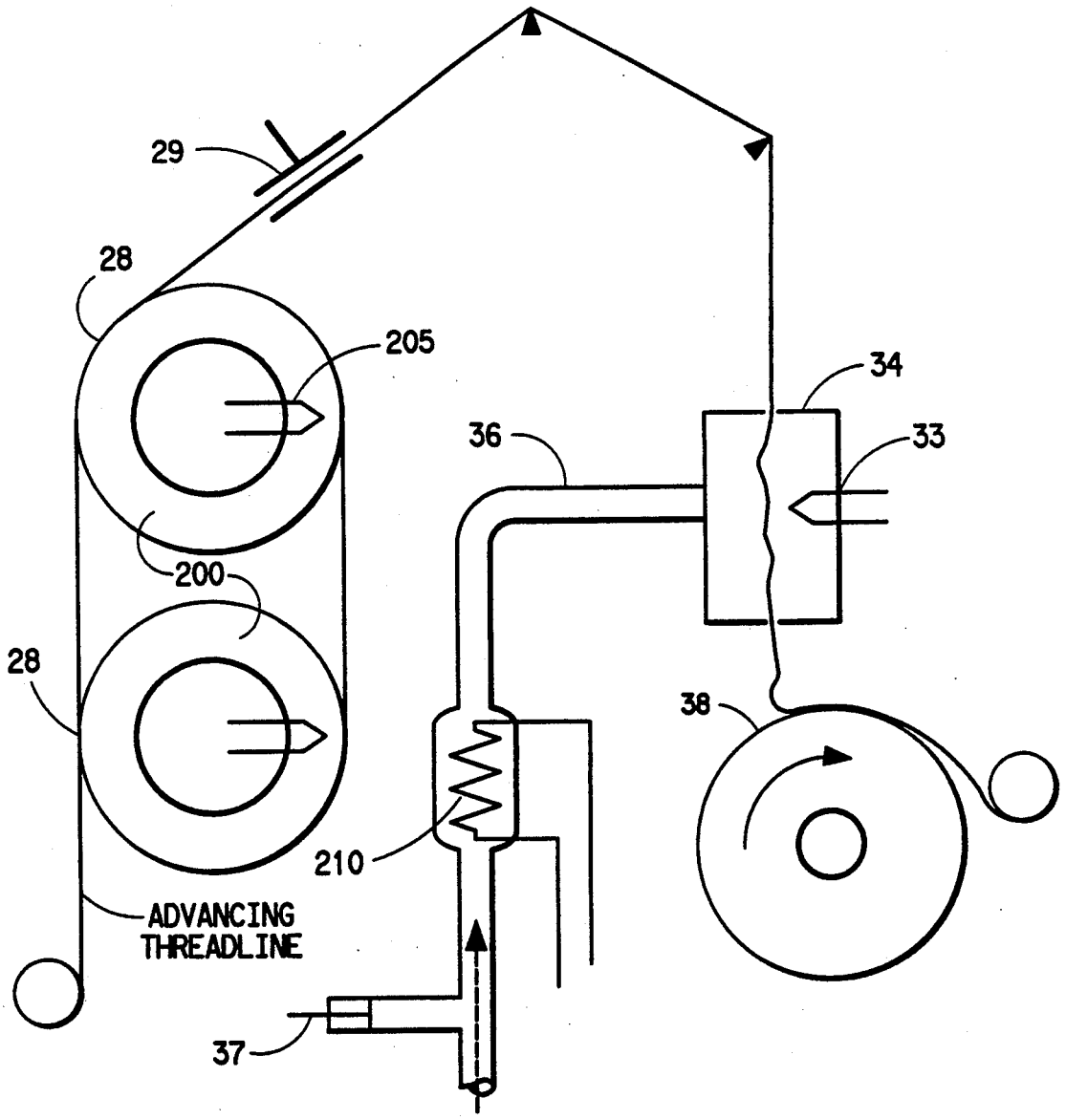
FIG. 1*b* is an enlarged portion of FIG. 1*a*.
Figure 2A:
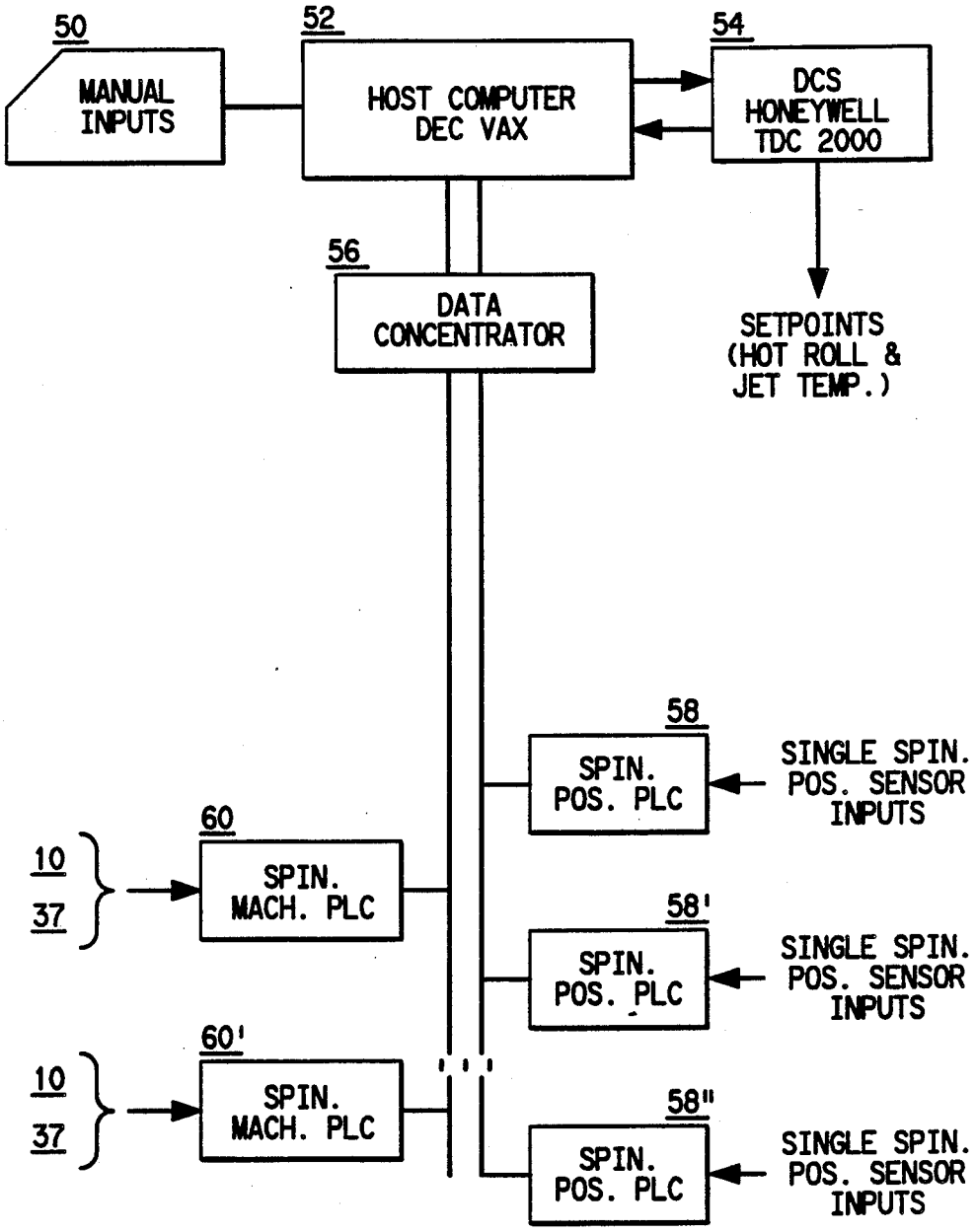
FIGS. 2*a* and 2*b* are schematic illustrations of the sensor inputs from a plurality of spinning machines and selected locations from a single position as shown in FIG. 1 coupled to a computer.

The process chosen for purposes of illustration in FIG. 1*a* includes a yarn 12 being spun as two separate threadlines from spinning pack 14. Molten polymer is supplied from a source (not shown) through piping 11 to the spinning pack 14. The relative viscosity of the polymer is sensed by viscometer 10 in piping 11. The polymer is metered through the spinning pack 14 by an electrically driven meter pump 8 which has its power consumption monitored by Hall effect device 9 as described in U.S. Pat. No. 3,555,537. Each threadline is forwarded in contact with a rotating finish applicator roll 16 driven in the direction shown by the arrow. The speed of the finish roll is detected by tachometer 18. Next the threadlines pass around feed roll 20 and its associated separator roll 22 around draw pin assemblies 24, tension sensor containing draw pin 26 to heated draw rolls 28. These rolls are illustrated in more detail in FIG. 1*b* which is an enlarged region of the process equipment shown in FIG. 1*a*. The advancing threadline is heated by the Rieter rolls 28 which are heated by the action of a hot vapor circulated through the annular spaces 200 within the rolls (the vapor source, heater and control elements are part of the standard construction of the Rieter rolls). Temperature control of the heated rolls is provided by sensing the vapor temperature with resistance thermometer detector (RTD) 205. This RTD signal which is proportional to temperature is sent to a control driver circuit which receives a set-point signal from distributed controller 54 (FIG. 2*a*) which adjusts the hot roll temperature in response to an aim value of the yarn property under control. The yarn is forwarded by the rolls 28 at a constant speed through a yarn temperature measuring heat flow detector 29 and through yarn guides 30 and through yarn passage ways 32 of jet bulking devices 34. In the bulking jets 34, the threadlines are subjected to the bulking action of hot pressurized fluid directed through units 36 (only one shown), the hot fluid exhausts with the threadline against a rotating drum 38 having a perforated surface on which the yarn cools to set the crimp. The jet fluid pressure is sensed by pressure transducer 37 coupled to the jet while the jet temperature is sensed by thermocouple 33. The bulking fluid passageways 36 connect to a chamber in the passageway having a resistance heater 210 (FIG. 1*b*) for maintaining the temperature of the bulking fluid. The bulking fluid is passed over heating element 210 in the direction indicated by the dotted arrow in FIG. 1*b*. In response to a control signal from a driver circuit (not shown) the resistance heater 210 is provided with more or less electrical current to maintain the desired temperature of the bulking fluid as measured at thermocouple 33. The temperature of the jet bulking fluid is fundamentally set in response to an aim value for the yarn property under control. The set point for the driver circuit (not shown) controlling this temperature is provided by distributed controller 54 (FIG. 2*a*). The threadlines, now in bulky form, pass to a turning guide 39 and in a path over a pair of tension measuring guides 17 to a pair of driven take up rolls 40, the speed of which is measured by roll drive frequency tachometers 41. Bulky yarns of this type are disclosed in U.S. Pat. No. 3,186,155 to Breen and Lauterbach. The threadlines are then directed over tension measuring guides 43 through fixed guides 42 and traversing guides 44 onto rotating cores 46 to form packages 48.

The sensors and controllers are all listed below in tabular form with more detailed descriptions.

| Element No. | Generic Name | Commercial Identity |
|---|---|---|
| 9 | Hall effect watt meter | F. W. BELL, model PX-2222BL 6120 Hanging Moss Road Orlando, FL 32807 (305) 678-6900 |
| 10 | Viscometer | Differential pressure viscometer in polymer transfer line, uses two pressure transducers, PT-422A, O-3000 psi |

-continued

| Element No. | Generic Name | Commercial Identity |
|---|---|---|
| | | DYNESCO, INC.<br>Elgin, Il 60120;<br>and type J thermocouple<br>0–400° C. |
| 17 | Tensiometer, ladder guide | SENSOTEC, INC., P/N<br>060-4892-01, 0–100 grams<br>1200 Chesapeake Avenue<br>Columbus, OH 43212<br>(614) 486-7723 |
| 18 | Tachometer, finish roll speed | Frequency controlled drive speed with voltage output conversion<br>EMERSON INDUSTRIAL CONTROLS<br>Grand Island, NY 14072;<br>and TTL level conversion,<br>BONITRON, INC.<br>Nashville, TN 37204 |
| 26 | Tensiometer draw zone | SENSOTEC, INC., P/N<br>060-4891-02, 0–5000 grams<br>1200 Chesapeak Avenue<br>Columbus, OH 43212 |
| 28 | Rieter vapor heated hot roll | RIETER MACHINE WORKS, INC.<br>P. O. Box 2378<br>Aiken, SC 29801 |
| 29 | Heat flow detector, yarn temperature | TRANSMET ENGINEERING, INC.<br>Sensor H4421/DR #7045 and<br>Firing Circuit P6202/Dr #7351<br>1060 Terra Bella Avenue<br>Mountainview, CA 94043<br>(415) 962-8110 |
| 33 | Thermocouple, bulking fluid temperature | THERMO-ELECTRIC, Type J,<br>JJ186-304-SS, custom per<br>Du Pont specification<br>AROBONE AND COMPANY<br>506 Bethlehem Pike<br>Fort Washington, PA 19034<br>(215) 628-9292 |
| 37 | Pressure transducer, bulking fluid | HONEYWELL SMART TRANSMITTER<br>ST3000, 4–20 ma.<br>1100 Virginia Drive<br>Fort Washington, PA 19034 |
| 41 | Tachometer, take-up roll speed | Frequency controlled drive speed with voltage output conversion,<br>EMERSON INDUSTRIAL CONTROLS,<br>Grand Island, NY 14072;<br>and TTL level conversion,<br>BONITRON, INC.,<br>Nashville, TN 37204 |
| 43 | Tensiometers, wind-up tension | SENSOTEC, INC., P/N<br>060-5731-01, 0–300 grams<br>1200 Chesapeak Avenue<br>Columbus, OH 43212 |
| 49 | Tachometers, wind-up speed | Frequency controlled drive speed with voltage output conversion,<br>EMERSON INDUSTRIAL CONTROLS,<br>Grand Island, NY 14072;<br>and TTL level conversion,<br>BONITRON, INC.,<br>Nashville, TN 37204 |
| 52 | Host supervisory computer | DEC VAX 11/785,<br>DIGITAL EQUIPMENT CORP.,<br>Maynard, MA 01754 |
| 54 | Distributed control system | Honeywell TDC 2000,<br>HONEYWELL, INC.<br>1100 Virginia Drive<br>Fort Washington, PA 19034 |
| 56 | Data concentrator | Allen-Bradley PLC-3,<br>ALLEN-BRADLEY COMPANY<br>Systems Division<br>747-T Alpha Drive<br>Highland Heights, OH 44143 |
| 58 | Spinning position PLC | Allen-Bradley PLC-5,<br>ALLEN-BRADLEY COMPANY<br>Systems Division<br>747-T Alpha Drive<br>Highland Heights, OH 44143 |
| 60 | Spinning machine PLC | Allen-Bradley PLC-5<br>ALLEN-BRADLEY COMPANY<br>Systems Division<br>747-T Alpha Drive<br>Highland Heights, OH 44143 |

Process conditions such as relative viscosity, temperature, tension and roll speeds and the generation of signals representing these process conditions are transmitted in turn to the host computer 52 shown in FIG. *2a*. FIG. *2a* illustrates the communication of process conditions from a plurality of fiber spinning machines 60 each having a plurality of spinning positions 58 per spinning machine. These process conditions are measured by suitable sensors which transmit their outputs to a programmable logic controller (PLC) associated with each spinning machine and spinning position. The PLC's communicate to the host computer 52 via a data concentrator 56 which is also a PLC. The process conditions are sensed as indicated in Table 1 below. FIG. *2b* shows the sensor inputs, associated with a single spinning position, connected to a spinning position PLC and the sensor inputs connected to a spinning machine PLC.

Statistically designed studies of the bulked yarn properties (bulk and dyeability) were made to determine correlations among the process conditions, measured at a spinning machine and multiple spinning positions, to be used as predictors of yarn properties. Several prediction model equations were developed as a result. Each model equation uses as inputs the sensor signals for a spinning machine and spinning position. In Table 2 the most general expression for a yarn property prediction model is given. The relative weights, the coefficients of a given sensor signal, determine the actual equation used to predict the property and in practice there may be zero-valued coefficients. The prediction equation derived for a given property and yarn product embodies a linear combination of the best predictors for that property. In the multiple correlation analysis only linear terms, cross terms between inputs and quadratic contributions were considered.

Once a property prediction equation is determined it can be used to control a fiber spinning process in real time. Programmed into the host computer is a general property prediction equation. A given product and product property aim is entered in the computer. The predicted property output is calculated from a database in the host computer comprised of the readings of process variables transmitted from the spinning process. The predicted property value is communicated to the distributed controller 54 in FIG. *2a* and entered as the argument of a P-I-D algorithm (e.g. P-I-D algorithms, Chapter I, sec. 1.2, Instrument Engineer's Handbook--Process Control, Edited by B. G. Liptak, Chilton Books, Radnor, Pa.; see also Honeywell TDC 2000 Reference Manual 25-220, Algorithm 01). Repetitive calculation of a predicted value for the property determines new setpoints which are communicated to process control drivers for the hot roll and bulking jet temperatures to provide real time control. Hot roll temperature and bulking jet fluid temperatures comprise the most basic leverage for maintaining aim process values of bulked yarn properties.

Polymer viscosity is determined by a viscometer 10 comprised of two pressure transducers and a polymer temperature sensing thermocouple in the polymer transfer line 11. Relative viscosity of the polymer is determined by the temperature and throughput compensated differential pressure measurement from the pressure transducers according to the following equations:

melt viscosity=(P1−P2)/[(throughput)*C1]

RV=[(melt viscosity)**C4 * (C2*T−C3)]+C5 where:

P1, P2=outputs from the two pressure transducers

T=polymer temperature throughput=from spinning position meter pump 8

C1=0.0001 to 0.0003 (dependent upon piping geometry)

C2=0.882

C3=232.

C4=0.3818

C5=0 to 3.0 (dependent upon degree of unfinished polymerization in the upstream piping)

The calculation of polymer RV is performed continuously in a spinning machine local controller and made available to the spinning machine PLC 60 which is in turn communicated to the host computer 52 via the data concentrator 56.

THE BULKED YARN PROPERTY PREDICTION MODEL
PROPERTY = INTERCEPT + LINEAR TERMS + INTERACTION TERMS + QUADRATIC TERMS

The linear, interaction or cross terms, and the quadratic or 2nd order dependence terms in the expression above are derived from sensor data indicated in Table 1.

TABLE 1

THE INPUTS TO THE PROPERTY PREDICTION MODEL
(Numbers refer to sensor locations as indicated in FIG. 1).

| | |
|---|---|
| HRT | Hot Roll Temperature (28) |
| JT | Jet Temperature (33) |
| JP | Jet Pressure (37) |
| FRS | Finish Roll Speed (18) |
| LG | Ladder Guide Tension (17) |
| DZT | Draw Zone Tension (26) |
| WT | Wind-up Tension (43) |
| YT | Yarn Temperature (29) |
| TU | Take-up Roll Speed (41) |
| WU | Wind-up Speed (49) |
| RV | Relative Viscosity (10) |
| HWM | Hall Effect Watt-Meter (9) |

TABLE 2

THE GENERALIZED PROPERTY PREDICTION EXPRESSION

| | |
|---|---|
| PROPERTY (BULK OR DYEABILITY) = | INTERCEPT + LINEAR TERMS + INTERACTION TERMS + SQUARE TERMS |
| LINEAR TERMS = | A*HRT + B*JT + C*JP + D*FRS + E*LG + F*DZT + G*WT + H*YT + I*TU + J*WU + K*RV + L*HWM |

INTERACTION TERMS:

| HRT | JT | JP | FRS | LG |
|---|---|---|---|---|
| $a_1$*HRT*JT | | | | |
| + $a_2$*HRT*JP | + $b_1$*JT*JP | | | |
| + $a_3$*HRT*FRS | + $b_2$*JT*FRS | + $c_1$*JP*FRS | | |
| + $a_4$*HRT*LG | + $b_3$*JT*LG | + $c_2$*JP*LG | + $d_1$*FRS*LG | |
| + $a_5$*HRT*DZT | + $b_4$*JT*DZT | + $c_3$*JP*DZT | + $d_2$*FRS*DZT | + $e_1$*LG*DZT |
| + $a_6$*HRT*WT | + $b_5$*JT*WT | + $c_4$*JP*WT | + $d_3$*FRS*WT | + $e_2$*LG*WT |
| + $a_7$*HRT*YT | + $b_6$*JT*YT | + $c_5$*JP*YT | + $d_4$*FRS*YT | + $e_3$*LG*YT |
| + $a_8$*HRT*TU | + $b_7$*JT*TU | + $c_6$*JP*TU | + $d_5$*FRS*TU | + $e_4$*LG*TU |
| + $a_9$*HRT*WU | + $b_8$*JT*WU | + $c_7$*JP*WU | + $d_6$*FRS*WU | + $e_5$*LG*WU |
| + $a_{10}$*HRT*RV | + $b_9$*JT*RV | + $c_8$*JP*RV | + $d_7$*FRS*RV | + $e_6$*LG*RV |
| + $a_{11}$*HRT*HWM | + $b_{10}$*JT*HWM | + $c_9$*JP*HWM | + $d_8$*FRS*HWM | + $e_7$*LG*HWM |

| DZT | WT | YT | TU | WU |
|---|---|---|---|---|
| + $f_1$*DZT*WT | | | | |
| + $f_2$*DZT*YT | + $g_1$*WT*YT | | | |
| + $f_3$*DZT*TU | + $g_2$*WT*TU | + $h_1$*YT*TU | | |
| + $f_4$*DZT*WU | + $g_3$*WT*WU | + $h_2$*YT*WU | + $i_1$*TU*WU | |
| + $f_5$*DZT*RV | + $g_4$*WT*RV | + $h_3$*YT*RV | + $i_2$*TU*RV | + $j_1$*WU*RV |
| + $f_6$*DZT*HWM | + $g_5$*WT*HWM | + $h_4$*YT*HWM | + $i_3$*TU*HWM | + $j_2$*WU*HWM |

| RV |
|---|
| + $k_1$*RV*HWM |

| | |
|---|---|
| SQUARE TERMS = | $m_1$*HRT**2 + $m_2$*JT**2 + $m_3$*JP**2 + $m_4$*FRS**2 + $m_5$*LG**2 + $m_6$*DZT**2 + $m_7$*WT**2 + $m_8$*YT**2 + $m_9$*TU**2 + $m_{10}$*WU**2 + $m_{11}$*RV**2 + $m_{12}$*HWM**2 |

In Table 2 the completely general expression for BCF yarn property prediction is given. The linear terms are weighted by coefficients A - L, the interaction terms are weighted by indexed coefficients a,b,c, . . . ,k, and the square terms weighted by coefficients m1, m2, m3, . . . ,m12.

Depending upon the BCF property to be predicted and the type of yarn, these coefficients may take on zero or non-zero values. Each model is validated against off-line testing for bulk and MBB dyeability. Coefficients are statistically determined for significance by empirical fit through multiple regression analysis of the off-line test results. The numerical value of the coefficients in the model equation used will depend on the sensor input value calibration and the engineering units used to express these input values and also on the specific process set-up and key process specifications such as: polymer type, mass throughput, quench rate, denier and filament cross section type.

Figure 2B:
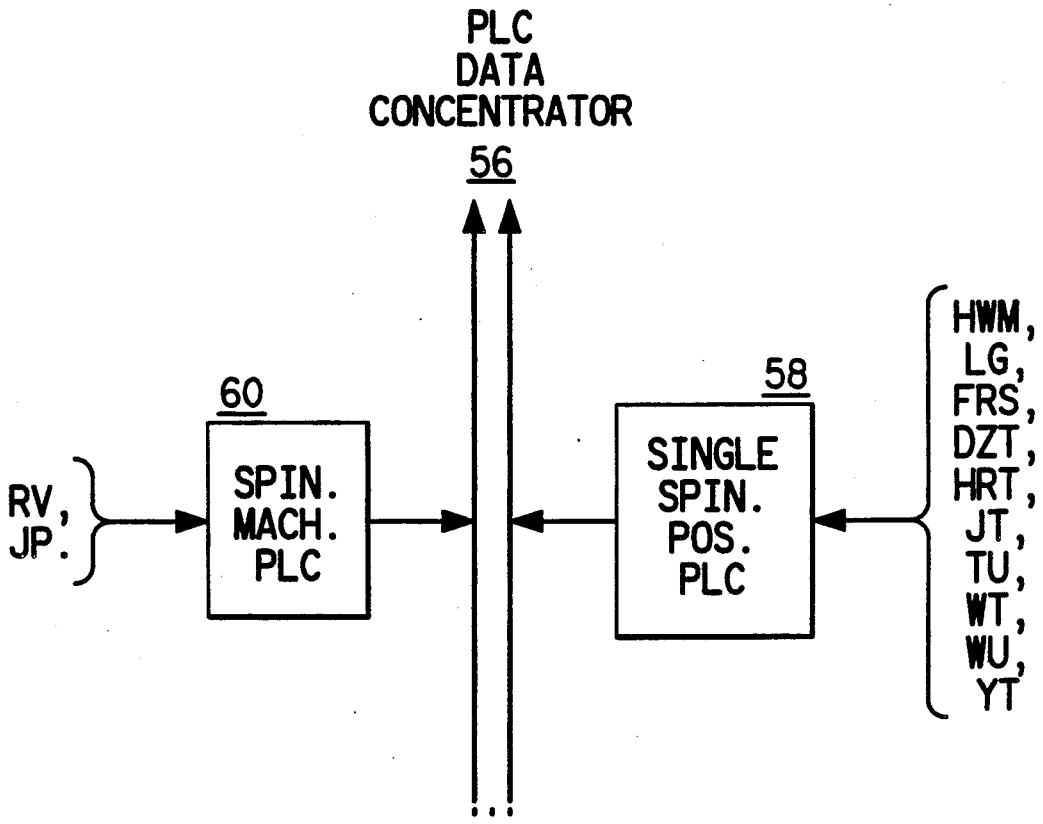
Figure 3A:
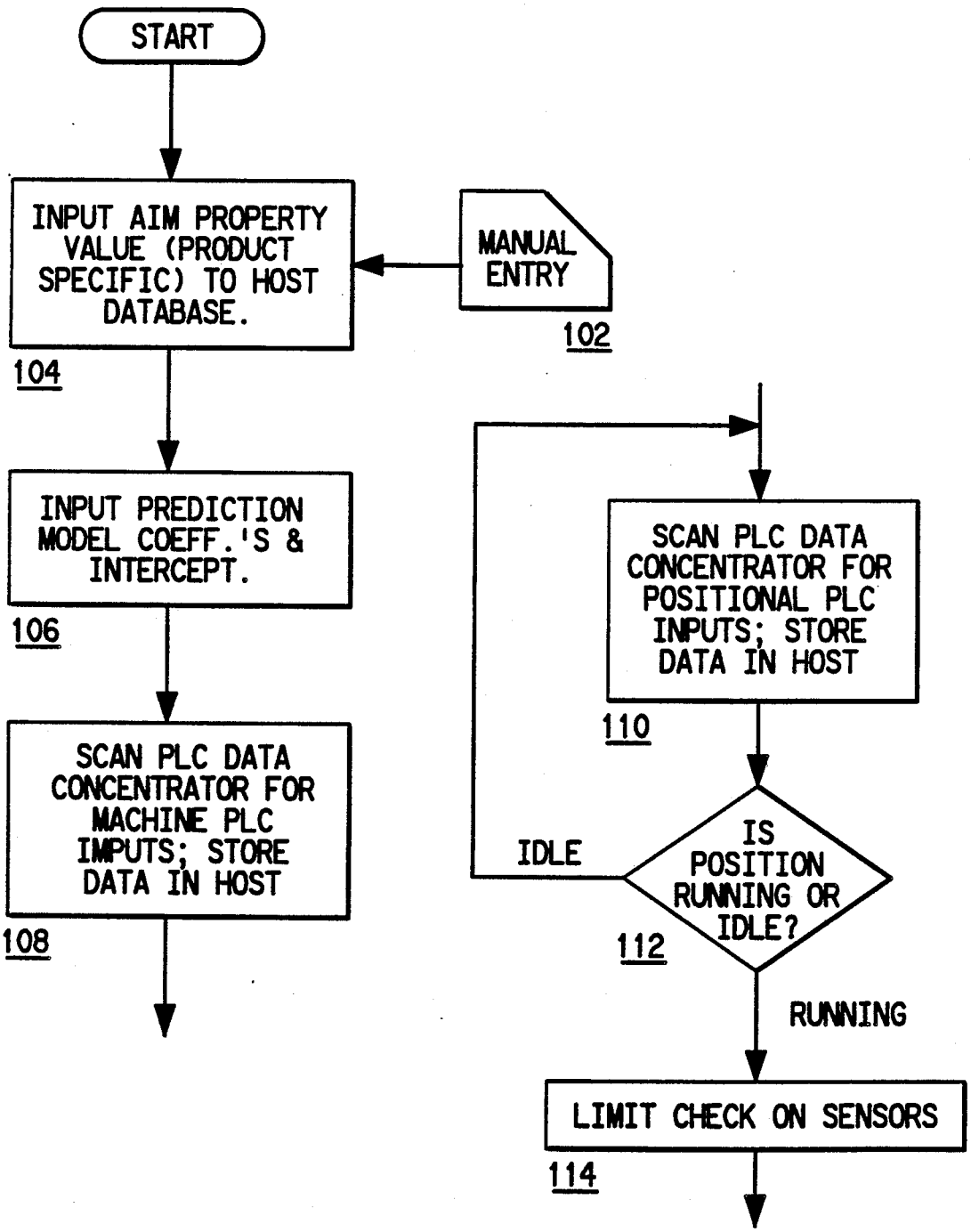
FIGS. 3*a*, 3*b* and 3*c* are logic flow diagrams depicting operation of the computer.
Figure 3B:
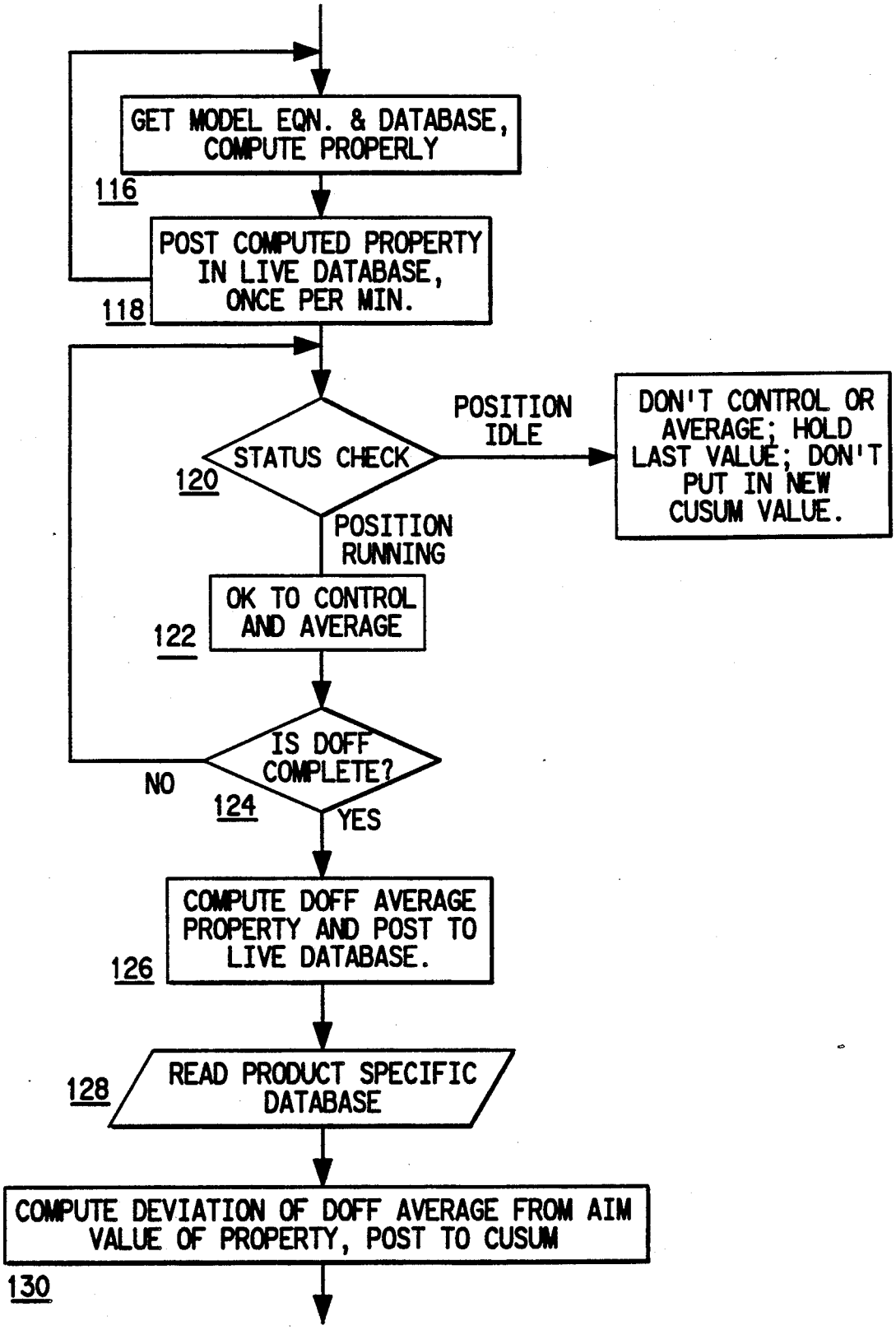
Figure 3C:
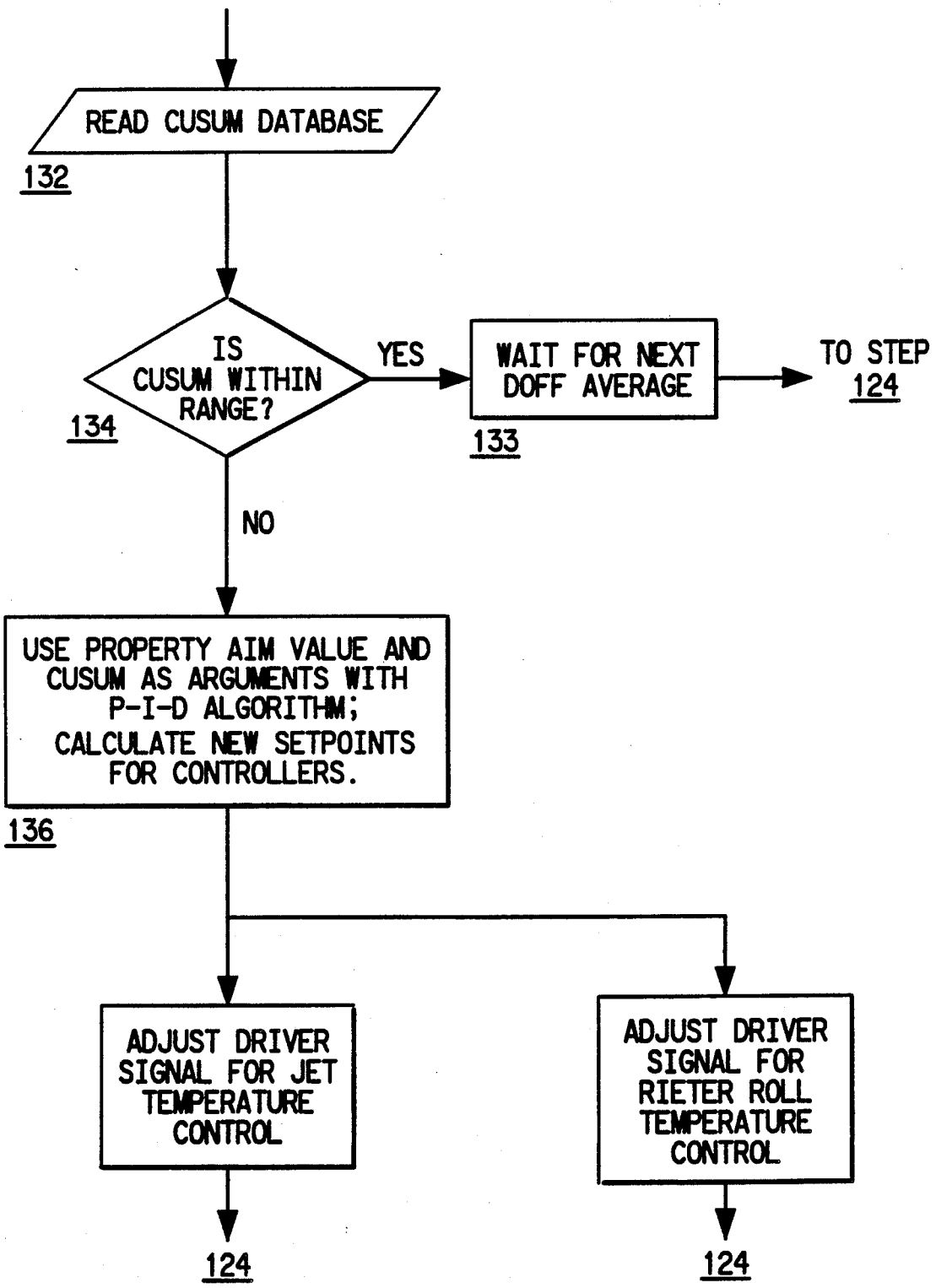

The logic for predicting bulk and MBB dye uptake rate is shown by the software flow charts in FIGS. 3*a*–3*b*. More particularly, the process of controlling yarn bulk is initiated by manually entering at step 102 a database associated with a particular bulky yarn product (fundamentally the aim value for bulk) and the model equation coefficients associated with this product. These values are read and stored in steps 104 and 106. In step 108 the data concentrator PLC is scanned by the host computer for new spinning machine inputs (illustrated in FIG. 2*b*). Likewise, in step 110 spinning position sensors (illustrated in FIG. 2*b*) are scanned for new data and stored. Idle spinning positions are detected in step 112 and running positions are subjected to a limit check of their sensor data in step 114. In step 116 the model equation is used with the combined spinning machine and spinning position sensor outputs to compute a predicted value for the yarn property (bulk). This value is posted (step 118) once per minute in the host computer's live database and recalculated by establishing the loop at step 118. Running positions are established in step 120, whereas idling positions are flagged and withheld from the control scheme. A running position is given a flag for control in step 122. All sensor data is used to compute a doff averaged property over that period of time until a doff of the yarn accumulated by that position occurs (step 126). The doff averaged yarn property is posted to the live database in the host. The product specific value of the yarn property is read in step 128 and compared with the doff averaged value of the property in step 130. The algebraic deviation of the doff averaged yarn property from aim is added cumulatively to a buffer called the CUSUM ("accumulated algebraic sum of error) database. The CUSUM database represents buildup of error or variability in the measurement which may occur over a period of time (see: Product Quality Management, D. W. Marquardt, Editor, Chapter 11, Process Control Concepts and Introduction to CUSUM Control", Chapter 12, "Design of CUSUM Control Schemes and Extensions", published by E. I. du Pont de Nemours and Company, Inc., 1988, and U.S. Pat. No. 4,675,378; J. D. Gibbon et al., assigned to Celanese Corporation). The CUSUM upper and lower limits are specified by prior manual entry for acceptable data. The CUSUM database is tested for acceptable data in step 134. If data is within a predetermined range as indicated by the current CUSUM value, the process is operating satisfactorily on aim and a return to step 124 is called. If the CUSUM is outside these predetermined limits, then an adjustment to either hot roll temperature or jet temperature is needed. This adjustment is provided by a PID algorithm which uses the CUSUM and yarn property aim value as arguments to determine new setpoints for controllers associated with the hot roll and jet temperatures in step 136. New setpoints are communicated in steps 138 to 140. The control system then returns to step 126 and waits for the next doff averaged data. The effects of the previously adjusted hot roll and/or jet temperatures will have influenced the yarn property average value for that doff.

In the same manner bulked yarn dyeability correlates among the process conditions as, for example, below are the two MBB dye model equations which were developed to provide the same uniformity in bulk and make yarn that dyes uniformly as indicated by tests on carpet yarns made at different times but under control of the model.

EXAMPLE

Dyeability Model Equation I. (MBB) *"CENTERED" VARIABLES $$\begin{aligned}DYE = {} & 239.0000 + (0.77000)*(HRT\text{-}170) + (.79707)*(JT\text{-}230) + \\ & (0.85000)*(FRS\text{-}111.11) + (1.232076)*(LG\text{-}20 + \\ & (-0.027058)*(DZT\text{-}1970) + (9.092125)*(RV\text{-}66) + \\ & (0.003218)*(HRT\text{-}170)*DZT(1970) + \\ & (0.39598)*(FRS\text{-}111.11)*(RV\text{-}66) + \\ & (-11.2773)*(TU\text{-}61.00)*(RV\text{-}66) + \\ & (-1.39508)*(HRT\text{-}170)*[(WU\text{-}TU\text{-}15.25)])] + \\ & (2.003403)*(HRT\text{-}170)*(TU\text{-}61.00) + \\ & (0.000051)*(DZT\text{-}1970) \quad 2\end{aligned}$$

*NOTE: to the model are in the same form as Bulk Model I. and are centered about the common values of the "standard operating conditions"variables.

EXAMPLE

Dyeability Prediction Model Equation II. (MBB) "UN-CENTERED" VARIABLES $$\begin{aligned}DYE = {} & 79.77 + \\ & (-0.201725)*HRT + (0.638726)*JT + (1.031268)*LG + \\ & (-1.3833)*WT + (0.303803)*YT + (0.299252)*LG*WT + \\ & (-0.039312)*LG \quad 2\end{aligned}$$

EXAMPLE I

Figure 4:
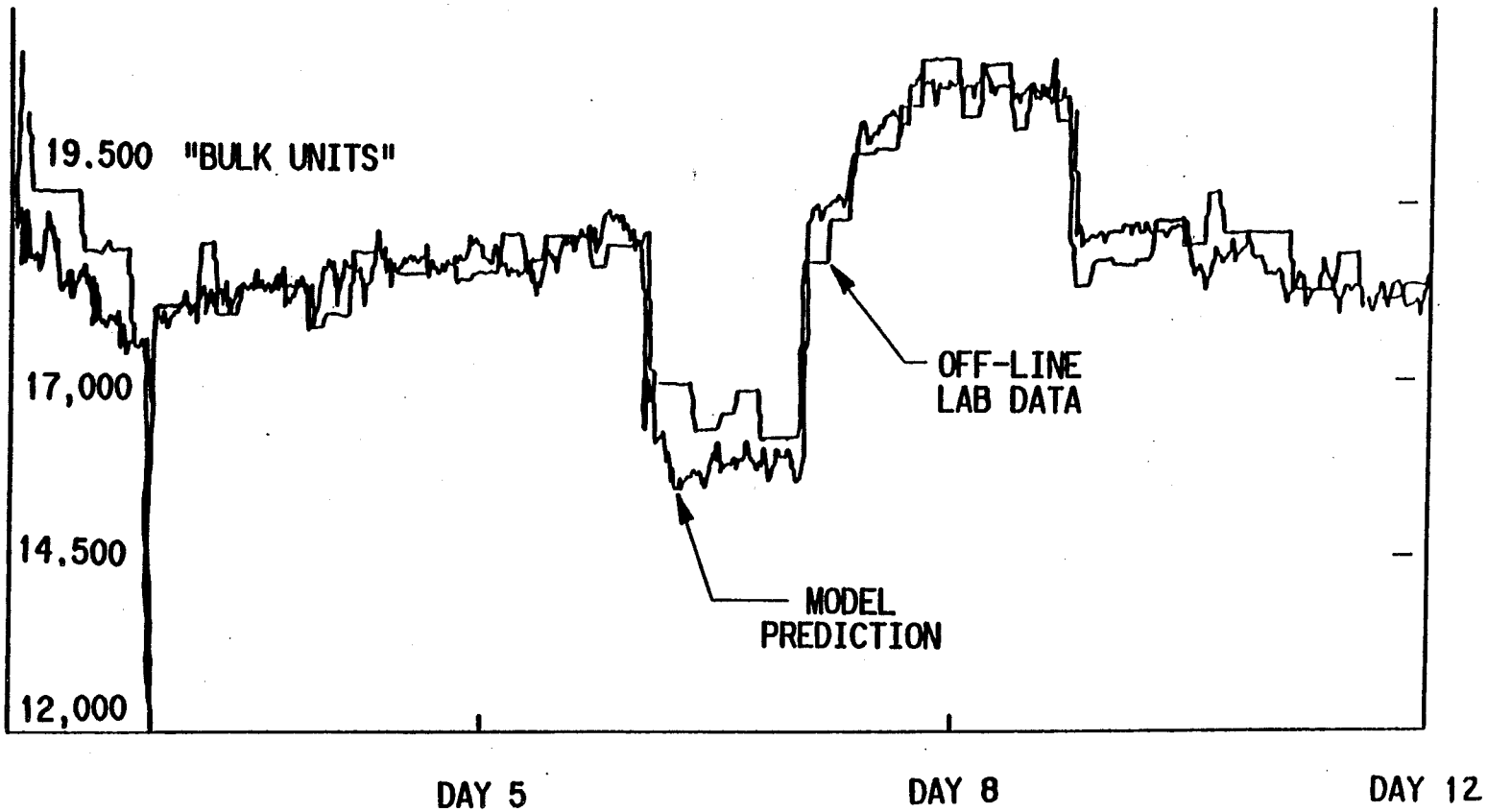
FIGS. 4–6 are plots of model prediction of bulk compared to off-line measurements of bulk.

The bulked continuous filament (BCF) yarn spinning process known as a coupled spin-draw-bulk process, disclosed by Breen et al. U.S. Pat. No. 3,854,177, was used to spin a thermoplastic multifilament yarn of nylon 6,6 (polyhexamethylene adipamide) on a multi-position spin-draw-bulk machine. In order to illustrate the preferred method of this invention to predict yarn bulk and use the predicted bulk to control the process, one position of a spin-draw-bulk machine is schematically shown in FIG. 1*a* along with the required bulk prediction model input sensors. Bulk level is expressed as a "bulk unit" and the prediction equations below are normalized to yield a bulk unit homogenous with that result obtained from a method of measuring yarn shrinkage and crimp development disclosed by Robinson et al. in U.S. Pat. No. 4,295,252. A multifilament yarn of 1100 denier/55 filaments and RV of 66.0+/−1.2, where RV is defined to be consistent with the method disclosed by Windley (U.S. Pat. No. 4,295,329), was spun at a temperature of about 290° C., a throughput of 73 pounds/hour and conventionally quenched in air by a 350 CFM cross flow of 50° C. air. The filaments have a trilobal cross section and a modification ratio of 2.3. An aqueous finish is applied prior to feed roll 20 which forwards the yarn at a speed of 897 m/min. The internally heated rolls 28 have a surface temperature of 153° C. and surface speed of 2518 m/min. to give a 2.85 draw ratio (draw zone tension was 2400 grams). The preheated yarn is advanced to jet 34 of a type described in U.S. Pat. No. 3,638,291 supplied with 230° C. nominal temperature air at a 12 atm nominal gauge pressure. The yarn is removed from the jet by the action of a moving screen which holds the yarn by vacuum on drum 38 (turning at 60 RPM). Take up roll 41 (surface speed of 2152 m/min.) removes the bulked yarn from the screen under a 35 gram tension from ladder guides 17 and forwards the yarn to a windup roll 48 where it is wound on a tube at 2192 m/min. and a windup tension of 83.6 grams. In FIG. 4 a 12-day test using Bulk Model I to predict bulk of a BCF yarn, processed as above, is compared with off-line bulk measurements. The hot roll temperature was manually varied by +/−6° C. about the nominal 158° C. surface temperature of the roll during days 6–9. Manual variation of the hot roll surface temperature was done to examine the ability of the bulk prediction model to follow transients in the hot roll temperature.

BULK MODEL I (IN CENTERED FORM)*

Intercept=20.42
Linear Terms=(0.2923)*(HRT-170)+
(0.0995)*(JT-230)−(0.0357)*(FRS-111.11)−
(0.00092)*(DZT-1970)−(0.237)*(LG-20)−
(0.2334)*(WT-60)
Interaction Terms=(0.00609)*(HRT-170)*(JT-230)+
(0.044)*(HRT-170)*(RV-66)−
(0.0090)*(HRT-170)*(LG-20)
−(0.00427)*(JT-230)*(FRS-111.11)−
(0.00419)*(JT-230)*
(LG-20 −(0.033)*(LG-20)*(RV-66)+
(0.0180)*(RV-66)*
(WT-60)
2 ND Order Terms=(0.0000045)*(DZT-1970)**2
*

Note: Inputs to the model are in the form of a difference between the observed input variable and mean value of the "standard operating conditions" variable, e.g. standard operating conditions were: HRT=170° C.; JT=230° C.; DZT=1970 grams; RV=66; FRS=111.11 Hz; LG=20 grams; WT=60 grams.

EXAMPLE II

Figure 5:
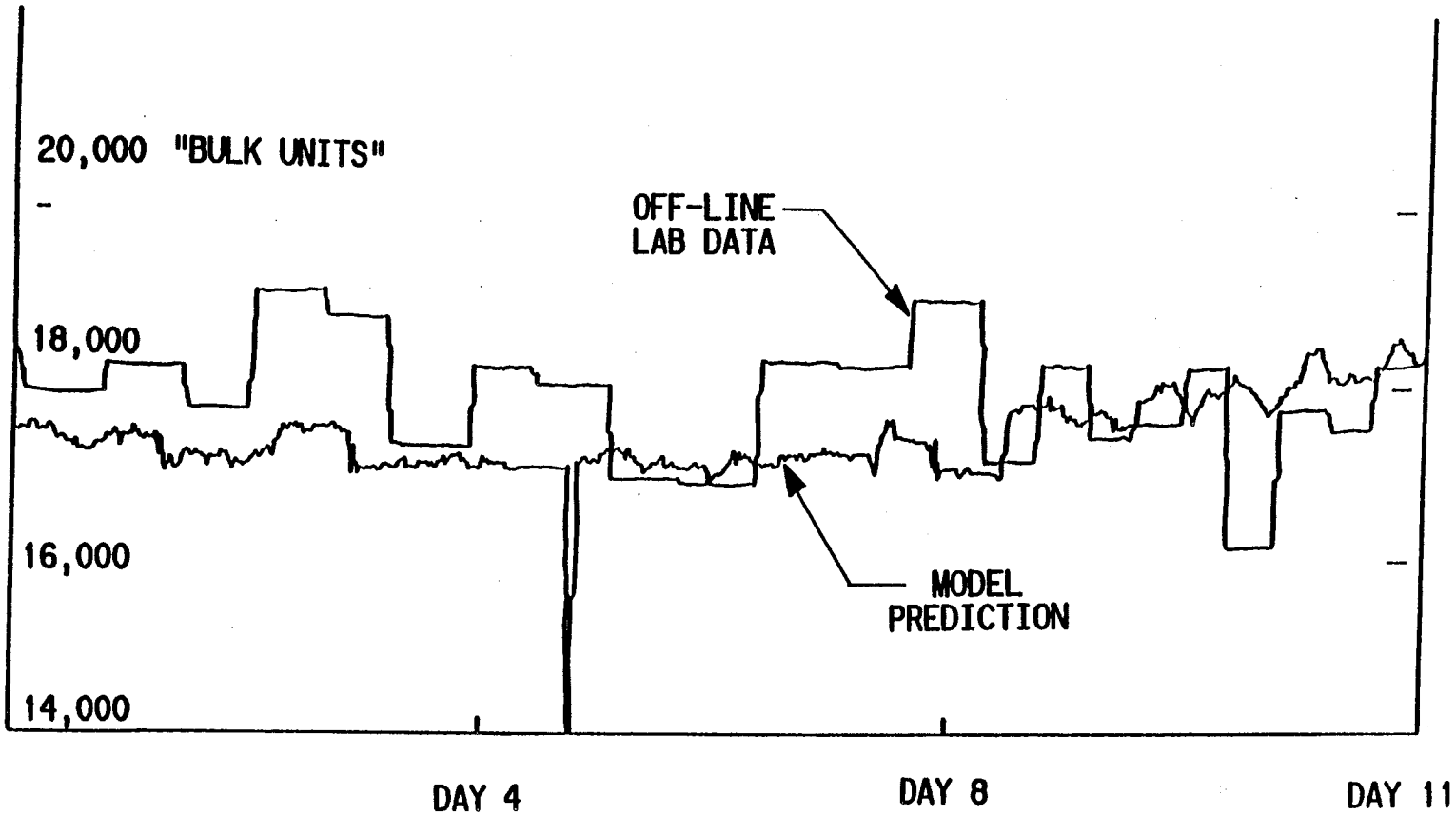

The same spin-draw-bulk process and product as described in Example I, except at a slightly higher throughput of 75 pounds/hour and the following roll speeds: feed roll 909 m/min.; hot roll 2550 m/min.; take-up roll 2178 m/min.; wind-up roll 2205 m/min, were used in a subsequent 11 day test illustrated in FIG. 5. Here, one position of the spinning machine was controlled by off-line (discontinuous) bulk measurements. The hot roll was used to maintain the bulk value sought (18.0 bulk units). The off-line bulk measurement is plotted along with the results of the continuous prediction of the yarn bulk level via Model II. An additional input from the Hall effect Watt meter 9 was used to implement Bulk Model II.

EXAMPLE III

Figure 6:
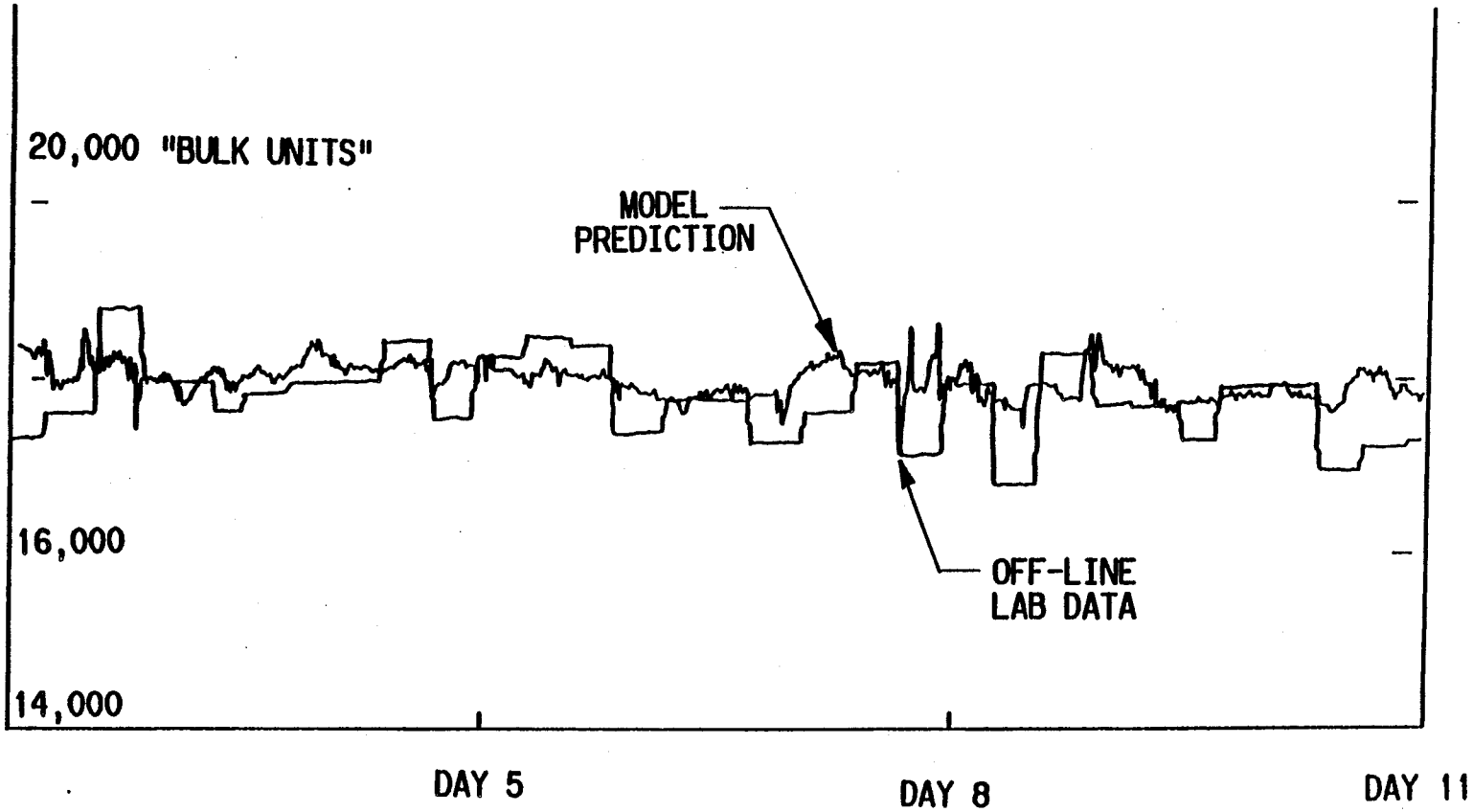

The same spin-draw-bulk process and product as described in Example II was used in the example illustrated by FIG. 6. During the 11 day test period, one position of a spinning machine was controlled continuously by Model II. The hot roll temperature was controlled by a setpoint established in response to the predicted bulk level of the processed yarn. Off-line lab bulk measurements are shown for the same test period for comparison.

BULK MODEL II.

(SENSOR INPUTS ARE THE DIRECT REALTIME VALUE, UNCENTERED)

Bulk=20.0000+(0.2834)*HRT+(0.1050)*JT+
(0.0487)*LG+(−0.0009)*DZT+(−0.2067)*RV+
(−2.219)*TU+(1.055)*WU+(−0.187)*HWM+
+(0.0002)*HRT*JT

We claim:

1. A method for predicting and controlling the bulk level of a bulked continuous filament yarn being formed by extruding filaments from a source of molten polymer, applying finish to said filaments, drawing said filaments in a heated environment, bulking the filaments by means of hot fluid in a jet, cooling the bulked filaments on a perforated surface, forwarding said filaments from said perforated surface under tension to a winder and wherein the filaments are subject to further tension by the action of the winder, said method being performed with the aid of a computer and comprising:

a) providing the computer with a data base for bulk level including at least the following parameters by sensing at sensor locations:
molten polymer relative viscosity (RV)
draw zone tension (DZT)
hot roll temperature (HRT)
jet temperature (JT)
jet pressure (JP)
ladder guide tension (LG)
take-up roll speed (TU)
windup tension (WT)
windup speed (WU)
finish roll speed (FRS)
yarn temperature (YT)
Hall Effect Wattmeter (HWM)

b) repetitively determining the value of said parameters as the yarn moves past said sensor locations;

c) repetitively providing the computer with the values of said parameters;

d) calculating in the computer at frequent intervals bulk levels of said yarn using the general equation Bulk Level=Intercept+Linear terms and their coefficients+interaction terms and their coefficients +quadratic terms and their coefficients;

and e) adjusting bulk level of the bulked continuous filament yarn toward the calculated bulk level by changing at least one of said parameters.

2. A method for predicting and controlling the dyeability level of a bulked continuous filament yarn being formed by extruding filaments from a source of molten polymer, applying finish to said filaments, drawing said filaments in a heated environment, bulking the filaments by means of hot fluid in a jet, cooling the bulked filaments on a perforated surface, forwarding said filaments from said perforated surface under tension to a winder and wherein the filaments are subject to further tension by the action of the winder, said method being performed with the aid of a computer and comprising:

a) providing the computer with a data base for dyeability level including at least the following parameters by sensing at sensor locations:
molten polymer relative viscosity (RV)
draw zone tension (DZT)
hot roll temperature (HRT)

jet temperature (JT)
jet pressure (JP)
ladder guide tension (LG)
take-up roll speed (TU)
windup tension (WT)
windup speed (WU)
finish roll speed (FRS)
yarn temperature (YT)
Hall Effect Wattmeter (HWM)

b) repetitively determining the value of said parameters as the yarn moves past said sensor locations;

c) repetitively providing the computer with the values of said parameters;

d) calculating in the computer at frequent intervals bulk levels of said yarn using the general equation Dye Level = Intercept + Linear terms and their coefficients + interaction terms and their coefficients + quadratic terms and their coefficients;

and e) adjusting bulk level of the bulked continuous filament yarn toward the calculated dye level by changing at least one of said parameters.

3. The method of claim 1 wherein said parameter is jet temperature.

4. The method of claim 1 wherein said parameter is hot roll temperature.

5. The method of claim 2 wherein said parameter is jet temperature.

6. The method of claim 2 wherein said parameter is hot roll temperature.

* * * * *